US006294221B1

(12) United States Patent
May et al.

(10) Patent No.: US 6,294,221 B1
(45) Date of Patent: Sep. 25, 2001

(54) PROCESS FOR SPRAY-COATING WITH FREQUENT CHANGES BETWEEN AQUEOUS AND NON-AQUEOUS COATING AGENTS INSIDE A SPRAY-COATING CHAMBER

(75) Inventors: Thomas May, Wuppertal; Manfred Glahsl, Duesseldorf; Axel Paulsen, Gevelsberg; Hans-Joachim Mueller, Hattingen, all of (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/520,812

(22) Filed: Mar. 8, 2000

(51) Int. Cl.[7] ..... B08B 9/27

(52) U.S. Cl. ..... 427/421; 134/22.1; 134/22.11; 134/22.14; 134/22.19; 134/38; 427/407.1; 427/409

(58) Field of Search ..... 427/421, 385.5, 427/388.5, 407.1, 409; 134/22.1, 22.11, 22.14, 22.19, 38

(56) References Cited

U.S. PATENT DOCUMENTS

| | | | | |
|---|---|---|---|---|
| 4,749,510 | * | 6/1988 | Nelson | 252/166 |
| 5,423,919 | * | 6/1995 | Dieter et al. | 134/8 |
| 5,700,330 | | 12/1997 | Stricker et al. | 134/22.19 |
| 5,759,975 | * | 6/1998 | Maxwell | 510/203 |
| 5,993,562 | * | 11/1999 | Roelofs et al. | 134/7 |
| 6,159,915 | * | 12/2000 | Machac, Jr. et al. | 510/201 |

FOREIGN PATENT DOCUMENTS 19823852 2/1999 (DE) .

* cited by examiner

*Primary Examiner*—Shrive P. Beck
*Assistant Examiner*—Jennifer Calcagni
(74) *Attorney, Agent, or Firm*—Joseph A. Tessari

(57) ABSTRACT

A non-aqueous rinsing medium is disclosed, and a process for using same as a rinsing agent in a process for spray-coating of mass-produced substrates (such as automobile bodies) with frequent changes between at least one aqueous and at least one non-aqueous coating agent inside a spray-coating chamber, wherein with at least each change of coating agent the installations to be rinsed are rinsed automatically with the non-aqueous rinsing medium consisting of (a) 20 to 35% by weight of one or more N-alkyl pyrrolidones, (b) 20 to 35% by weight of butyl acetate and/or isobutyl acetate, (c) 10 to 20% by weight of one or more glycol ethers, which are water-miscible without miscibility gap, (d) 5 to 15% by weight of ethanol, propanol and/or isopropanol, (e) 10 to 20% by weight of one or more aliphatic C4–C7-ketones, (f) 0 to 5% by weight of one or more organic solvents conventionally used in coating agents, and (g) 0 to 5% by weight of one or more auxiliary agents, whereby components (a), (c) and (d) comprise 40 to 60% by weight of the total rinsing medium.

6 Claims, No Drawings

PROCESS FOR SPRAY-COATING WITH FREQUENT CHANGES BETWEEN AQUEOUS AND NON-AQUEOUS COATING AGENTS INSIDE A SPRAY-COATING CHAMBER

BACKGROUND OF THE INVENTION

The present invention relates to a process for spray-coating of mass-produced goods with frequent changes between at least one aqueous and at least one non-aqueous coating agent inside a spray-coating chamber.

The coating of vehicles in a production line takes place in fully automated vehicle coating lines whereby the application of the colour-determining coating layer (as finishing top coat layer or as base coat layer with a transparent top coal layer) is carried out with a number of different colour shades with frequent changes of colour. The change of colour or colour shade results from the manufacturing schedule and can take place after each coating operation of an automotive body, or the bodies are assembled in small groups of the same colour shade. Each coating agent with a different colour shade is supplied to the spray-coating devices from a coating supply reservoir via a dedicated circulation line connected thereto.

To obtain an automatic change of colour shades, it is sufficient to switch from one circulation line to another circulation line, so long as the feeding lines, the metering devices, as well as the spray-coating devices themselves, are automatically rinsed between applications of different colour shades. When changing colour in spray-coating chambers, in which non-aqueous coating agents of different colour shades are handled, this automatic rinsing is carried out with mixtures of water-immiscible organic solvents conventionally used in coating agents. However, the colour change in the spray-coating chambers, in which aqueous coating agents with different colour shades are handled, is followed by automatic rinsing with rinsing media which contain as main constituents water and water-miscible organic solvents conventionally used in aqueous coating agents, and which contain optional additional auxiliary agents in small quantities. The respective rinsing medium is also supplied from the supply reservoir to the colour changer via a dedicated circulation line and can be supplied from there to the spray-coating devices via the supply lines and the metering devices.

The time available for the actual change of colour, and therefore for the rinsing operation, is dependent upon the speed at which the vehicles are being conveyed through the spray chamber and on the distance between the automotive bodies. In practice, the conveyor speed and the distance are adjusted to the period of time required for the change of colour and the rinsing process, which totals for example 5 to 20 seconds. Quite apparently, productivity suffers with any delay, so there is a need to decrease the amount of time needed between application of different coating colours or colour shades.

There has been a focus in recent years, particularly in the vehicle manufacturing/assembly plants, to replace non-aqueous (i.e., solvent-based) coating systems with aqueous coating systems due to environmental considerations. The actual replacement of non-aqueous coatings with aqueous coatings, however, has been problematic, especially with basecoats and topcoats which provide, respectively, a particular colour or a desired property or effect to the article (e.g., an automobile) being coated. The need to apply both solvent based and aqueous based coatings adds considerable complexity to the coating process, particularly if the same spray chamber needs to be used to apply both types of coatings. In such situations, rinsing of the supply lines, metering devices and spray-coating devices themselves, can't be carried out with either the conventional rinsing agents used for solvent based coatings nor those conventionally used for aqueous based coatings alone. Instead, the two types of rinsing media need to be used in sequential rinsing steps and in the proper order. A change of colour from an aqueous to a non-aqueous coating agent, for example, would result in the following sequence:

- termination of the application of an aqueous coating agent with the colour shade A;
- rinsing of the supply lines, the metering devices and of the spray devices with
  - a rinsing medium which contains, as essential constituents, water and water-miscible organic solvents conventionally used in aqueous coating agents and which contains optional additional auxiliary agents in small quantities;
- rinsing with mixtures of water-immiscible organic solvents conventionally used in non-aqueous coating agents; and
- application of a non-aqueous coating agent with the colour shade B.

The same applies for a change of colour from a non-aqueous to an aqueous coating agent. This multiple step process, with an additional rinsing step, obviously results in lower productivity as it is impossible to realize such a sequence for each change of colour in the short time that is available for the rinsing operation. In addition to the decrease in efficiency and productivity, the consumption of rinsing media as well as the quantity and costs for waste disposal would increase. It is, of course, possible to utilize two separate spray apparatus in a single spray chamber, one dedicated to aqueous coatings and the other dedicated to non-aqueous coatings. However, this alternative clearly adds capital costs to the vehicle manufacturing process and is thus not a satisfactory solution.

Solvent mixtures are known in the art which are said to be suitable for cleaning surfaces contaminated with solvent coatings or water-borne coatings. For example, U.S. Pat. No. 5,700,330 discloses a solvent mixture consisting of 15 to 35% by weight of one or more glycol ethers and of 65 to 85% by weight of one or more aliphatic ketones, which can be used for cleaning instruments that have been contaminated either by coating agents containing solvents or by water-dilutable coating agents. An improved solvent mixture is taught by DE A 198 23 852, which discloses a solvent mixture consisting of 20 to 65% by weight of one or more glycol ethers, 9 to 40% by weight of one or more aliphatic ketones, 10 to 35% by weight of one or more aliphatic monohydric alcohols and 5 to 20% by weight of one or more organic solvents, selected from the group of the N-substituted pyrrolidones and/or butyrolactone.

It is an object of the invention to provide a process for spray-coating mass-produced substrates, in particular automotive bodies and their parts, using aqueous as well as non-aqueous coating agents inside a spray-coating chamber. The process is intended to overcome the aforementioned problems and to be suited particularly for coating operations that require frequent changes in the coatings being applied. A solution to the problem is obtained by coating mass-produced substrates with aqueous and non-aqueous coating agents inside one and the same spraying chamber and by rinsing the installations to be rinsed of that particular coat-applying unit with a universal non-aqueous rinsing medium of a given composition each time the coating agent is changed. By "installations to be rinsed" are meant in particular the supply lines from the coat changer to the spray-coating devices, including the metering devices as well as the spray-coating devices themselves.

SUMMARY OF THE INVENTION

Accordingly, the invention provides a non-aqueous rinsing medium for use in rinsing a coating apparatus between changes in coating agents, said rinsing medium consisting of:

(a) 20 to 35% by weight of at least one N-alkyl pyrrolidone;

(b) 20 to 35% by weight of an acetate selected from butyl acetate, isobutyl acetate and mixtures thereof;

(c) 10 to 20% by weight of at least one completely water-miscible glycol ether;

(d) 5 to 15% by weight of an alcohol selected from ethanol, propanol, isopropanol and mixtures thereof;

(e) 10 to 20% by weight of at least one aliphatic ketone having 4 to 7 carbon atoms;

(f) 0 to 5% by weight of at least one organic solvent conventionally used in coating agents, and (g) 0 to 5% by weight of at least one auxiliary agents, wherein the sum of the components in part (a), part (c) and part (d) is between 40% and 60% by weight, based on the weight of the entire rinsing medium.

In another embodiment, the invention provides a process for spray-coating of mass-produced substrates with frequent changes between at least one aqueous and at least one non-aqueous coating agent inside a spray-coating chamber, characterized in that in between changes in coating agents, the spray apparatus is rinsed with a non-aqueous rinsing medium consisting of:

(a) 20 to 35% by weight of at least one N-alkyl pyrrolidone;

(b) 20 to 35% by weight of an acetate selected from butyl acetate, isobutyl acetate and mixtures thereof, (c) 10 to 20% by weight of at least one completely water-miscible glycol ether;

(d) 5 to 15% by weight of an alcohol selected from ethanol, propanol, isopropanol and mixtures thereof, (e) 10 to 20% by weight of at least one aliphatic ketone having 4 to 7 carbon atoms;

(f) 0 to 5% by weight of at least one organic solvent conventionally used in coating agents, and (g) 0 to 5% by weight of at least one auxiliary agents, wherein the sum of the components in part (a), part (c) and part (d) is between 40% and 60% by weight, based on the weight of the entire rinsing medium.

The term "non-aqueous coating agent" means a liquid coating agent based on organic solvents.

The term "non-aqueous rinsing medium" means a liquid, anhydrous rinsing medium, which may contain water merely as a technical contaminant, but to which no water is added, either during its production process or later in time.

In the process according to the invention, mass-produced substrates, such as for example in particular automotive bodies and their parts, are spray-coated inside a spraying chamber using aqueous and non-aqueous coating agents. Each coating agent is supplied to an application device by, for example, a circulation line connected to a supply reservoir of the coating agent and a coat changer, and from there towards the application devices via usual supply lines and metering devices (pressure controllers, pumps, valves).

Examples of application devices are conventional spray-coating devices, functioning with air where appropriate, such as rotating nebulizers, airless-nebulizers and pneumatic nebulizers. Spray-coating of mass-produced substrates is automated. The substrates pass for example through the automatically operating application devices with a prescribed conveyor speed, and are spray-coated, with the respective coating agent having been determined by the production schedule. The successive substrates may or may not be assembled thereby in successive groups, each of which is to be coated with the same coating agent, for example colour shade groups.

In the process according to the invention, at least one aqueous and at least one non-aqueous coating agent are handled with frequent changes inside a spray-coating chamber. Preferably the coating is applied by only one coat-applying unit, which is operated with frequent changes between the one or more aqueous and the one or more non-aqueous coating agents. The coating agents handled inside a spray-coating chamber can be for example aqueous or non-aqueous pigmented coating agents each having an identical colour shade, or can be aqueous and non-aqueous clear coats. In the case of the preferred embodiment of the process according to the invention, mass-produced substrates, such as for example automotive bodies and their parts, are spray-coated inside a spraying chamber with one or more aqueous and one or more non-aqueous pigmented coating agents each having a different colour shade. 15 to 20 colour shades for example are handled inside one spraying chamber. The aqueous and non-aqueous coating agents handled inside a spray-coating chamber can be for example aqueous and non-aqueous filler coats to be processed with a number of different colour shades, or the coating agents are in particular those coating agents which serve to apply the coating layer that determines the colour of the substrate, in particular for example pigmented aqueous and non-aqueous top coats or colour- and/or effect-giving aqueous and non-aqueous base coats.

In the process according to the invention the installations to be rinsed are automatically rinsed, at least with each change of coating agent, with the non-aqueous rinsing medium of this invention.

The preferred composition of the non-aqueous rinsing medium is composed of (a) 20 to 30% by weight of one or more N-alkyl pyrrolidones, (b) 20 to 30% by weight of an acetate selected from the group consisting of butyl acetate, isobutyl acetate and mixtures thereof, (c) 10 to 15% by weight of one or more glycol ethers, which are completely water-miscible, (d) 5 to 15% by weight of an alcohol selected from the group consisting of ethanol, propanol, isopropanol and mixtures thereof, (e) 10 to 20% by weight of one or more aliphatic C4–C7-ketones, (f) 0 to 5% by weight of one or more organic solvents conventionally used in coating agents, and (g) 0 to 5% by weight of one or more auxiliary agents, whereby the sum of the percentage parts by weight of components in (a), (c), and (d) is 45 to 55% by weight.

The composition of the non-aqueous rinsing medium contains one or more N-alkyl pyrrolidones, the preferred N-alkyl pyrrolidone being N-methyl pyrrolidone.

The glycol ethers are preferably selected from the group of methyl glycol, ethyl glycol, isopropyl glycol, butyl glycol, methyl diglycol, ethyl diglycol, butyl diglycol, ethyl triglycol, butyl triglycol, methoxypropanol, ethoxypropanol, propoxypropanol, propylene glycol dimethyl ether, dipropylene glycol dimethyl ether, diethylene glycol dimethyl ether, dipropylene glycol monomethyl ether and methoxybutanol. Preferred are ethylene glycol ethers, in particular butyl glycol and butyl diglycol.

The composition of the non-aqueous rinsing medium contains 5 to 15% by weight of ethanol, propanol and/or isopropanol. Propanol and isopropanol are thereby preferred, in particular propanol.

The aliphatic C4–C7-ketones are preferably ketones selected from the group of methyl ethyl ketone, methyl isobutyl ketone, methyl isoamyl ketone and cyclohexanone. Preferred are methyl ethyl ketone and methyl isobutyl ketone.

The composition of the non-aqueous rinsing medium can contain 0 to 5% by weight of one or more organic solvents conventionally used in coating agents, for example glycols such as ethylene glycol, propylene glycol, diethylene glycol, dipropylene glycol, triethylene glycol, tripropylene glycol; alcohols such as butanol, secondary butanol or higher alcohols; glycol ethers (which can be water-immiscible or only partly water miscible), such as hexyl glycol, butoxypropanol, dipropylene glycol butyl ether, tripropylene glycol butyl ether; glycol ether esters such as ethyl glycol acetate, butyl glycol acetate, butyl diglycol acetate, methoxypropyl acetate, methyl glycol acetate, ethoxypropyl acetate; glycol esters such as propylene glycol diacetate; aromatic and aliphatic hydrocarbons, for example toluene or xylene, or linear or branched aliphatic C6–C12-hydrocarbons.

The composition of the non-aqueous rinsing medium can contain 0 to 5% by weight of one or more auxiliary agents, in particular auxiliary agents conventionally used in coating agents, such as surfactants, surface-active agents and neutralizing agents, such as for example amines or alcohol amines.

Particularly preferred is a non-aqueous rinsing media with a composition of (a) 20 to 30% by weight of N-methyl pyrrolidone, (b) 20 to 30% by weight of butyl acetate, (c) 10 to 15% by weight of butyl glycol, (d) 5 to 15% by weight of propanol, (e) 10 to 20% by weight of a mixture of methyl ethyl ketone and methyl isobutyl ketone in weight proportions of 0,5:1 to 1:0,5, and (f) 0 to 5% by weight of surfactants, surface-active agents and/or neutralizing agents, whereby the N-methyl pyrrolidone, butyl glycol and propanol together comprise 45 to 55% by weight.

The preferred non-aqueous rinsing media are those with a flash point that remains over 40° C.

The invention also relates to the use of a non-aqueous rinsing medium with the composition as described above for the automatic rinsing of the installations of coat-applying units to be rinsed at least with each change of coating agent, which units are operated inside a spray-coating chamber in which mass-produced substrates are spray-coated with frequent changes between at least one aqueous and at least one non-aqueous coating agent.

The use according to the invention of the non-aqueous rinsing medium with the previously described composition makes it possible to comply with the requirements of the object of the invention. A process is provided for spray-coating of mass-produced substrates using not only aqueous but also non-aqueous coating agents inside a spraying chamber, wherein the installations to be rinsed, at least with each change of coating agent, are automatically rinsed with a universal rinsing medium. Furthermore, the use of the non-aqueous rinsing medium guarantees that the automatic rinsing is achieved with a rinsing result which is adequate for the obtaining of high-quality coating results within a short time, in particular within the short time defined by conveyor speed and cycle time. A carry-over of coating agent components of the preceding coating agent from the rinsed installations into the coating agent subsequently applied can be avoided as a result of the excellent rinsing effect.

In the process according to the invention, the installations to be rinsed at least with each change of coating agent are automatically rinsed with the non-aqueous rinsing medium. The installations of a coat-applying unit to be rinsed are in particular the supply lines from the coat changer to the coat application devices including the metering devices as well as the application devices themselves. In the preferred embodiment according to the invention, each change of coating agent involves also a change of colour shade, unconditional on whether the change is made from an aqueous to a non-aqueous coating agent or vice-versa, or if the change is made between different aqueous or different non-aqueous coating agents. It can be expedient to carry out the automatic rinsing not only with each change of coating agent, but also after the coating of each single substrate, for example to avoid a drying of the coating agent on the application device.

The total period of time available for the change of coating agent and the rinsing of the installations to be rinsed, as defined by conveyor speed and distance (cycle time) between the individual substrates or between the substrates assembled in the aforementioned groups, is for example 5 to 20 seconds. For reasons of productivity this total period of time is calculated to be as short as possible. The change of coating agent as such lasts for example 2 to 10 seconds, whereas the actual rinsing operation takes a period of time of 3 to 15 seconds for example. A change of coating agent from coating agent A to coating agent B is carried out in a conventional and known manner. It consists for example of the following automated, consecutive operational steps. First the application of coating agent A is terminated by cutting off the corresponding coat supply at the coat changer. The subsequent automatic rinsing operation takes place in a manner known as such. First the non-aqueous rinsing medium which is provided at the coat changer from a supply reservoir via a dedicated circulation line is for example supplied under pressure to the supply lines from the coat changer to the coat application devices which include the metering devices as well as the application devices themselves. This occurs by forcing out (displacing) coating agent A. The supply lines from the coat changer to the coat application devices, including the metering devices and the application devices themselves, are rinsed by the multiple (for example two to ten) changes between the non-aqueous rinsing medium and the compressed air. This takes place for example at room temperature and under a pressure of 5 to 10 bar.

In the case, for example, of a vehicle coating production line, depending on the constructional properties of the particular coat application installation, between 500 and 2000 ml of the non-aqueous rinsing medium are used for a rinsing operation including the rinsing of all the application devices. Finally, rinsing is effected with compressed air. The supply under pressure of the non-aqueous rinsing medium from the final rinsing with compressed air takes a period of time of for example 3 to 15 seconds. The next coating agent B is then supplied under pressure and its application begins.

The process according to the invention can be carried out with two or more application units, for example one unit for the application of aqueous coating agents and one unit for the application of non-aqueous coating agents, whereby each rinsing is carried out with the non-aqueous rinsing medium. However, it is preferred to use the process according to the invention with only one application unit, namely an application unit which is operated with frequent changes between the one or more aqueous and the one or more non-aqueous coating agents, whereby each rinsing operation of the installations to be rinsed is carried out with the non-aqueous rinsing medium.

The process according to the invention makes it possible to carry out spray-coating of mass-produced substrates inside a spraying chamber using aqueous as well as non-aqueous coating agents while achieving a high-quality coating result. The automatic rinsing operation which takes place at least with each change of coating agent, which may or may not involve a change of colour shade, is efficiently achieved in a short period of time while using only one rinsing medium.

What is claimed is:

1. A process for spray-coating of mass-produced substrates with frequent changes between at least one aqueous and at least one non-aqueous coating agent inside a spray-coating chamber, which coating agents are delivered via installations associated with the spray coating chamber, characterized in that with at least each change of coating agent the installations are rinsed automatically with a non-aqueous rinsing medium consisting of:

(a) 20 to 35% by weight of at least one N-alkyl pyrrolidone;

(b) 20 to 35% by weight of an acetate selected from butyl acetate, isobutyl acetate and mixtures thereof;

(c) 10 to 20% by weight of at cast one completely water-miscible glycol ether;

(d) 5 to 15% by weight of an alcohol selected from ethanol, propanol, isopropanol and mixtures thereof;

(e) 10 to 20% by weight of at least one aliphatic ketone having 4 to 7 carbon atoms;

(f) 0 to 5% by weight of at least one organic solvent conventionally used in coating agents, and (g) 0 to 5% by weight of at least one auxiliary agents, wherein the sum of the components in part (a), part (c) and part (d) is between 40% and 60% by weight, based on the weight of the entire rinsing medium.

2. The process according to claim 1, characterized in that the non-aqueous rinsing medium consists of:

(a) 20 to 30% by weight of at least one N-alkyl pyrrolidone, (b) 20 to 30% by weight of an acetate selected from the group consisting of butyl acetate, isobutyl acetate and combinations thereof, (c) 10 to 15% by weight of at least one completely water-miscible glycol ethers, (d) 5 to 15% by weight of an alcohol selected from the group consisting of ethanol, propanol, isopropanol and mixtures thereof (e) 10 to 20% by weight of at least on aliphatic C4–C7-ketone, (f) 0 to 5% by weight of at least one organic solvents conventionally used in coating agents, and (g) 0 to 5% by weight of at least one auxiliary agents, whereby the components in (a), (c) and (d) total 45 to 55% by weight of the rinsing medium.

3. The process according to claim 1, characterized in that the installations are constituent parts of a coat application unit which is used for the application of at least one aqueous and of at least one non-aqueous coating agent.

4. The process according to claim 2, characterized in that the substrates are automotive bodies.

5. The process according to claim 1, wherein the at least one aqueous coating agent and the at least one non-aqueous coating agent are selected from the group consisting of:

(a) clear coat compositions, (b) pigmented coating agents each having an identical colour shade, (c) pigmented coating agents each having a different colour shade.

6. The process according to claim 5, wherein the coating agents each having a different colour shade are selected from the group consisting of filler coats, top coats and base coats.

* * * * *

UNITED STATES PATENT AND TRADEMARK OFFICE

CERTIFICATE OF CORRECTION

PATENT NO. : 6,294,221 B1
DATED : September 25, 2001
INVENTOR(S) : Thomas May et al.

It is certified that error appears in the above-identified patent and that said Letters Patent is hereby corrected as shown below:

Column 8,
Line 31, delete the number "2" and substitute the number -- 1 -- therein Signed and Sealed this Thirtieth Day of April, 2002

*Attest:*

*Attesting Officer*

JAMES E. ROGAN
*Director of the United States Patent and Trademark Office*